US008710345B2

(12) United States Patent
Tabata

(10) Patent No.: US 8,710,345 B2
(45) Date of Patent: Apr. 29, 2014

(54) PERFORMANCE APPARATUS, A METHOD OF CONTROLLING THE PERFORMANCE APPARATUS AND A PROGRAM RECORDING MEDIUM

(71) Applicant: Casio Computer Co., Ltd., Tokyo (JP)

(72) Inventor: Yuji Tabata, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/794,625

(22) Filed: Mar. 11, 2013

(65) Prior Publication Data

US 2013/0239784 A1 Sep. 19, 2013

(30) Foreign Application Priority Data

Mar. 14, 2012 (JP) ..... 2012-057917

(51) Int. Cl.
*G10H 1/18* (2006.01)

(52) U.S. Cl.
USPC ..... 84/615; 84/626; 84/743

(58) Field of Classification Search
USPC ..... 84/615, 626, 653, 662, 743
See application file for complete search history.

(56) References Cited

U.S. PATENT DOCUMENTS 5,017,770 A * 5/1991 Sigalov ..... 250/221
5,081,896 A * 1/1992 Hiyoshi et al. ..... 84/600
5,369,270 A * 11/1994 Gurner et al. ..... 250/221
5,475,214 A * 12/1995 DeFranco et al. ..... 250/221
5,648,627 A * 7/1997 Usa ..... 84/600
5,663,514 A * 9/1997 Usa ..... 84/600
6,388,183 B1 * 5/2002 Leh ..... 84/645
6,492,775 B2 * 12/2002 Klotz et al. ..... 315/120
6,919,503 B2 * 7/2005 Nishitani et al. ..... 84/633
6,960,715 B2 * 11/2005 Riopelle ..... 84/725
7,009,100 B2 * 3/2006 Ando ..... 84/600
7,723,604 B2 * 5/2010 Bang et al. ..... 84/615
8,198,526 B2 * 6/2012 Izen et al. ..... 84/743
2012/0144979 A1 * 6/2012 Tansley ..... 84/645
2012/0253667 A1 * 10/2012 Sakazaki ..... 701/461

FOREIGN PATENT DOCUMENTS

JP 3599115 B2 12/2004

* cited by examiner

*Primary Examiner* — Jeffrey Donels
(74) *Attorney, Agent, or Firm* — Holtz, Holtz, Goodman & Chick, PC

(57) ABSTRACT

A performance apparatus prevents a player's unintentional motion from being detected as a playing, thereby generating no sound, when the player plays a virtual musical instrument. The performance apparatus has a player operated stick, a ROM for storing layout information, which correlates plural areas set on a virtual plane to tone colors, respectively, an image sensor for continuously taking pickup images of a subject including the stick, and a CPU for calculating a difference image between a first pickup image and a second pickup image taken prior to the first pickup image and for detecting an operating position of the stick based on the difference image. A CPU refers to the ROM to specify a tone color correlated to the area corresponding to the operating position detected by the CPU. And a sound source generates a tone of the tone color specified by the CPU.

9 Claims, 7 Drawing Sheets

PERFORMANCE APPARATUS, A METHOD OF CONTROLLING THE PERFORMANCE APPARATUS AND A PROGRAM RECORDING MEDIUM

CROSS-REFERENCE TO RELATED APPLICATION

The present application is based upon and claims the benefit of priority from the prior Japanese Patent Application No. 2012-057917, filed Mar. 14, 2012, the entire contents of which are incorporated herein by reference.

BACKGROUND OF THE INVENTION

1. Field of the Invention

The present invention relates to a performance apparatus, a method of controlling the performance apparatus and a program recording medium.

2. Description of the Related Art

In the past, performance apparatuses have been proposed, which generate an electronic sound in response to a playing motion performed by a player, when the player's playing motion is detected. For example, performance apparatuses (air drums) are known, in which only performance members of a stick type, having a built-in sensor are used to generate percussion sounds. When the player holds the performance members with his or her hands and swings the performance members down as if the player drums percussion instruments, the performance apparatus detects the player's playing motion with the built-in sensors of the performance members and generates the percussion sounds in response to the detected player's playing motions.

Using the performance apparatus in place of a real musical instrument, the player can generate sounds of such musical instrument. Therefore, the players are allowed to enjoy a musical instrument performance without feeling any constraint in place and/or space.

For example, Japanese Patent Publication No. 3599115 proposes a musical instrument/game machine, which takes a moving image of the player, who performs a playing motion holding performance members of a stick type, and displays on a monitor a combined image of the moving image of the player and a virtual image of a musical instrument set.

When the position of the performance member falls within any one of plural areas of the musical instruments in the virtual image, the musical instrument/game machine generates a sound of the musical instrument corresponding to the area of the musical instrument.

In the musical instrument/game machine disclosed in Japanese Patent Publication No. 3599115, parts of the musical instrument set are correlated with the apparatus areas, respectively. Therefore, when a sound is generated only based on the area of the musical instrument, it is possible for the musical instrument/game machine to detect the player's unintentional motion as his or her intended motion and generate a sound based on such detected player's unintentional motion.

SUMMARY OF THE INVENTION

The present invention has been made to solve the problems involved in the conventional apparatuses. The invention provides a performance apparatus, a method of controlling the performance apparatus, and a program recording medium, which prevent a player's unintentional motion from being detected as his or her intended playing motion, when the player plays the virtual musical instrument set, thereby generating no sound based on the player's unintentional motion.

According to one aspect of the invention, there is provided a performance apparatus, which comprises a performance member operated by a player, an image pickup unit for continuously taking pickup images including the performance member and a virtual plane, a storing unit for storing layout information including positions of plural areas set on the virtual plane, a position detecting unit for detecting a position of the performance member on the virtual plane of a first pickup image and a position of the performance member on the virtual plane of a second pickup image among the pickup images taken by the image pickup unit, wherein the second pickup image was taken prior to the first pickup image, a present position determining unit for comparing the two positions of the performance member detected by the position detecting unit to judge whether the difference between the two positions of the performance member is more than a predetermined value, and for setting the position of the performance member on the virtual plane of the first pickup image as the present position of the performance member when it is determined that the difference between the two positions of the performance member is more than the predetermined value, and setting the position of the performance member on the virtual plane of the second pickup image as the present position of the performance member when it is determined that the difference between the two positions of the performance member is less than the predetermined value, and a sound-generation instructing unit for giving an instruction of generating a musical tone corresponding to the area including the present position of the performance member determined by the present position determining unit, when the difference between the two positions of the performance member detected by the position detecting unit is more than the predetermined value and the present position of the performance member determined by the present position determining unit is included in one of the plural areas, positions of which are included in the layout information.

The invention prevents the player's unintentional motion from being detected as his or her intended playing motion, when the player plays the virtual musical instrument set, thereby generating no sound based on the player's unintentional motion.

DETAILED DESCRIPTION OF THE PREFERRED EMBODIMENTS

Now, preferred embodiments of the present invention will be described with reference to the accompanying drawings.

[General Description of Performance Apparatus]

The general outline of the performance apparatus 1 according to the embodiments of the invention will be described with reference to FIG. 1A and FIG. 1B.

Figure 1A:
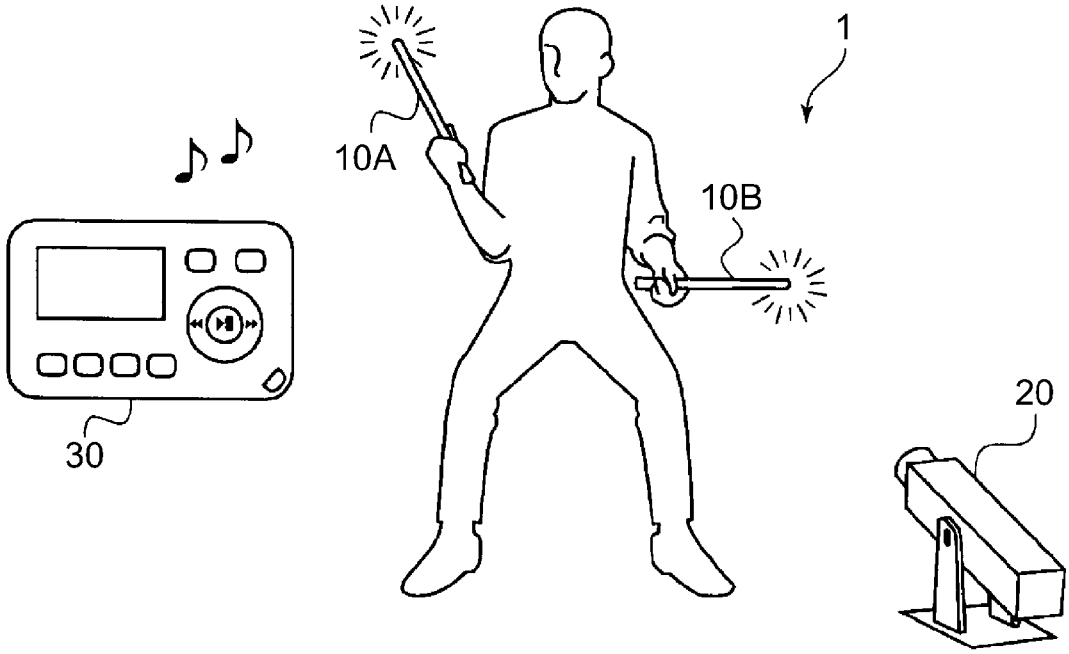
FIG. 1A is a view showing a general outline of a performance apparatus according to the embodiment of the present invention.
Figure 1B:
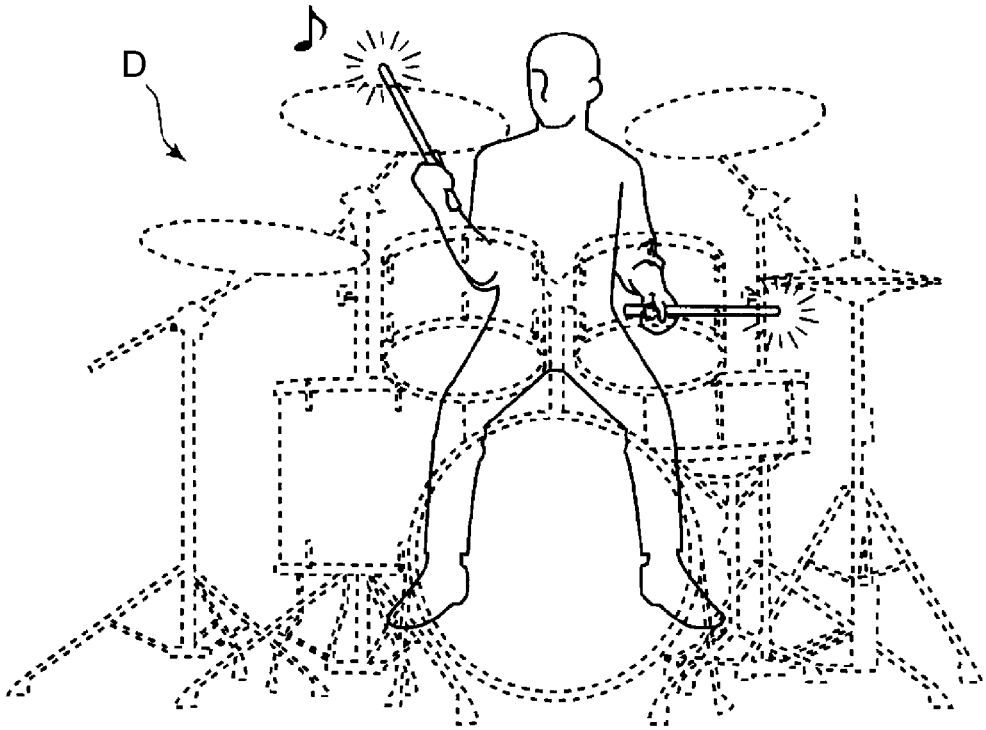
FIG. 1B is a view showing a virtual drum set in an imaging space.

FIG. 1A is a view showing the general outline of the performance apparatus 1 according to the embodiments of the present invention. FIG. 1B is a view showing a virtual drum set in an imaging space to be described later. As shown in FIG. 1A, the performance apparatus 1 according to the embodiment of the present invention comprises stick units 10A, 10B, a camera unit 20, and a center unit 30. In the performance apparatus 1 according to the present embodiment, there are prepared two stick units 10A, 10B to realize a virtual drum performance using two sticks, but the number of stick units is not limited to two. For instance, one stick unit, three stick units or more can be used instead of the two stick units. Hereinafter, in the case where there is no need to separate the stick units 10A and 10B, these two stick units 10A, 10B will be collectively referred to as the "stick unit" 10.

The stick unit 10 is a playing member of a stick type, which extends in its longitudinal direction. A player holds the stick unit 10 at its one end portion (base portion) with his or her hand and performs a playing motion to swing the stick unit 10 up and down, holding his or her wrist at the center of the motion. At the other end portion (head portion) of the stick unit 10, there are provided various sorts of sensors (motion sensor 14) such as an acceleration sensor and angular rate sensor to detect the player's playing motion. The stick unit 10 generates and sends a note-on event to the center unit 30 based on the playing motion detected by the various sorts of sensors.

Further, the stick unit 10 is provided with a marker unit 15 (refer to FIG. 2 and FIG. 3) at its front-edge portion and the camera unit 20 uses the marker unit 15 to detect the head portion of the stick unit 10 while shooting the player's playing motion.

The camera unit 20 comprises an optical image-pickup apparatus. The camera unit 20 is uses to take images of a space (hereinafter referred to as the "imaging space") including an object at a predetermined frame rate, and outputs the images of the space as moving-image data, wherein the object in the imaging space includes the player performing playing motion. The camera unit 20 specifies a position coordinates of the marker unit 15 emitting light in the imaging space and sends data (hereinafter referred to as the "position-coordinate data") representing the specified position coordinate data of the marker unit 15 to the center unit 30.

Upon receipt of the note-on event from the stick unit 10, the center unit 30 generates a musical tone depending on the received position-coordinate data of the marker unit 15. More specifically, the center unit 30 previously stores the position-coordinate data of the virtual drum set "D" (shown in FIG. 1B) related to the imaging space of the camera unit 20. The center unit 30 specifies a musical instrument, which the player has virtually drummed with the stick unit 10, depending on the position-coordinate data of the virtual drum set "D" and the position-coordinate data of the marker unit 15 specified at the time when the center unit 30 has received the note-on event, and generates a musical tone of the specified musical instrument.

When the player performs some operation on the stick unit 10, the center unit 30 generates a predetermined musical tone in accordance with the position-coordinate data of the marker unit 15 of the stick unit 10 specified at the time when it has received the note-on event. More specifically, the center unit 30 previously stores the position-coordinate data of virtual wind chimes 91 (see FIG. 7) related to the imaging space of the camera unit 20. The virtual wind chimes are one of the virtual musical instruments composing the virtual drum set "D". The center unit 30 specifies a position of the virtual wind chimes 91, which the player has virtually drummed with the stick unit 10, depending on the position-coordinate data of the virtual wind chimes 91 and the position-coordinate data of the marker unit 15 specified at the time when the center unit 30 has received the note-on event, and generates a musical tone corresponding to the specified position.

Now, a specific configuration of the performance apparatus 1 according to the present embodiment of the invention will be described.

[Configuration of Performance Apparatus]

The composing elements of the performance apparatus 1 according to the present embodiment will be described with reference to FIG. 2 to FIG. 5. That is, the configurations of the stick units 10, camera unit 20, and the center unit 30 will be described in detail.

[Configuration of Stick Unit]

Figure 2:
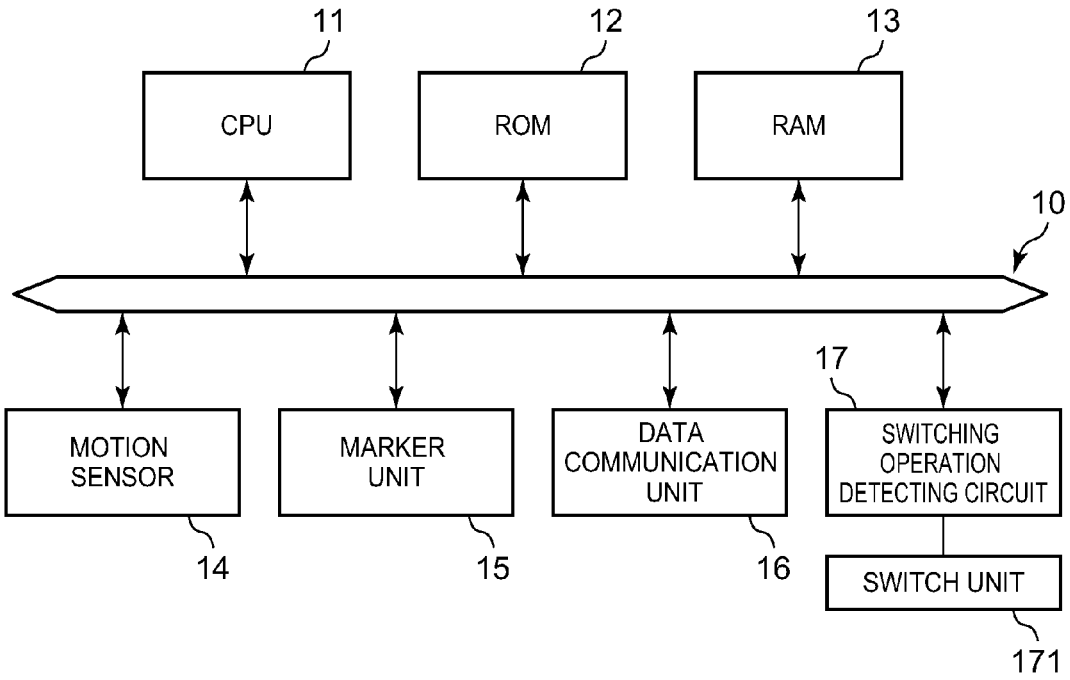
FIG. 2 is a block diagram of a hardware configuration of a stick unit composing the performance apparatus according to the embodiment of the invention.

FIG. 2 is a block diagram of a hardware configuration of the stick unit 10. As shown in FIG. 2, the stick unit 10 comprises CPU (Central Processing Unit) 11, ROM (Read Only Memory) 12, RAM (Random Access Memory) 13, the motion sensor 14, marker unit 15, a data communication unit 16 and a switching operation detecting circuit 17.

CPU 11 controls the whole operation of the stick unit 10. For example, CPU 11 detects a posture of the stick unit 10 based on a sensor value output from the motion sensor unit 14. Further, CPU 11 controls a light emitting operation and a light-emission ceasing operation of the marker unit 15 in addition to a shot detecting operation and an action detecting operation. At this time, CPU 11 reads marker featuring information from ROM 12 to control the light emitting operation of the marker unit 15. Further, CPU 11 controls a communication with the center unit 30 through the data communication unit 16.

ROM 12 serves to store a process program for CPU 11 to perform various processes. In ROM 12 is stored the marker featuring information, which is used by CPU 11 to control the light emitting operation of the marker unit 15. The marker featuring information is used to discriminate between the marker unit 15 (hereinafter, referred to as the "first marker") of the stick unit 10A and the marker unit 15 (hereinafter, referred to as the "second marker") of the stick unit 10B. For example, a blinking ratio of the light of the marker unit 15 with the light turned on can be used as the marker featuring information in addition to a shape, size, color phase, intensity, and/or brightness of the light of the marker unit 15 with the light turned on.

CPU 11 of the stick unit 10A and CPU 11 of the stick unit 10B read separate pieces of marker featuring information respectively from ROM 12, 12 provided respectively in the stick unit 10A and the stick unit 10B, thereby controlling the light emitting operations of the respective marker units 15, 15.

RAM 13 serves to temporarily store various values obtained or generated during the course of the process, including sensor values output from the motion sensor unit 14.

The motion sensor unit 14 comprises various sorts of sensors for detecting states of the stick unit 10. For example, the acceleration sensor, angular rate sensor and a magnetic sensor can be used as the sensors composing the motion sensor unit 14.

Figure 3:
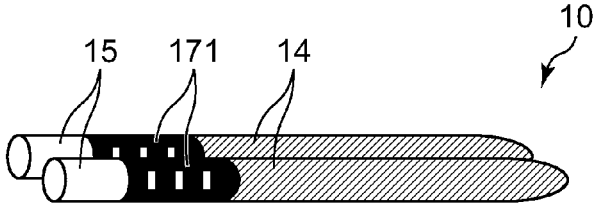
FIG. 3 is a perspective view showing appearances of the stick units composing the performance apparatus according to the embodiment of the invention.

FIG. 3 is a perspective view showing appearances of the stick units 10, 10. Each stick unit 10 has a switch unit 171 and the marker unit 15 disposed on it external surface.

The player holds the one end portion (base portion) of the stick unit 10 with his or her hand to swing the stick unit 10 up and down keeping his or her wrist at the center of the swinging motion, thereby giving the stick unit 10 motion. Then, the motion sensor unit 14 outputs a sensor value corresponding to the motion given to the stick unit 10.

Upon receipt of the sensor value output from the motion sensor unit 14, CPU 11 detects the state of the stick unit 10 held by the player. As an example, CPU 11 detects a timing at which the player has drummed the virtual musical instrument with the stick unit 10. Hereinafter, this timing is referred to as the "shot timing". The shot timing is represented by the time just before the player has stopped swinging the stick unit 10 after swung it down. In other words, the shot timing is represented by the time when a value of acceleration applied to the stick unit 10 has exceeded a threshold value, wherein the acceleration is applied to the stick unit 10 in the direction opposite to the direction in which the stick unit 10 is swung down.

The marker unit 15 is a light emitting body such as LED, mounted on the top of the head portion of the stick unit 10. The marker unit 15 emits light or ceases emitting light under control of CPU 11. More particularly, the marker unit 15 emits light based on the marker featuring information read from ROM by CPU 11. Since the marker featuring information of the stick unit 10A is different from the marker featuring information of the stick unit 10B, the camera unit 20 can obtain the position coordinates of the marker unit (first marker) of the stick unit 10A and the position coordinates of the marker unit (second marker) of the stick unit 10B, separately.

The data communication unit 16 performs a predetermined wireless communication at least with the center unit 30. The data communication unit 16 can use an arbitrary communicating method to perform the wireless communication, and in the present embodiment the data communication unit 16 performs an infrared communication with the center unit 30. The data communication unit 16 can perform the wireless communication with the camera unit 20. Further, it is possible to make the data communication unit 16 of the stick unit 10A perform the wireless communicate with the data communication unit 16 of the stick unit 10B.

The switching operation detecting circuit 17 is connected with the switch unit 171, and receives input-information through the switch unit 171. The input-information contains, for example, a signal (hereinafter, referred to as the "wind-chime operation signal") serving as triggering to operate the virtual wind chimes 19. The wind-chime operation signal is generated, when either the switch unit 171 of the stick unit 10A or the switch unit 171 of the stick unit 10B, which ever previously determined one, is turned on. But it is possible to generate wind-chime operation signal, when either the switch unit 171 of the stick unit 10A or the switch unit 171 of the stick unit 10B is turned on.

[Configuration of Camera Unit]

Figure 4:
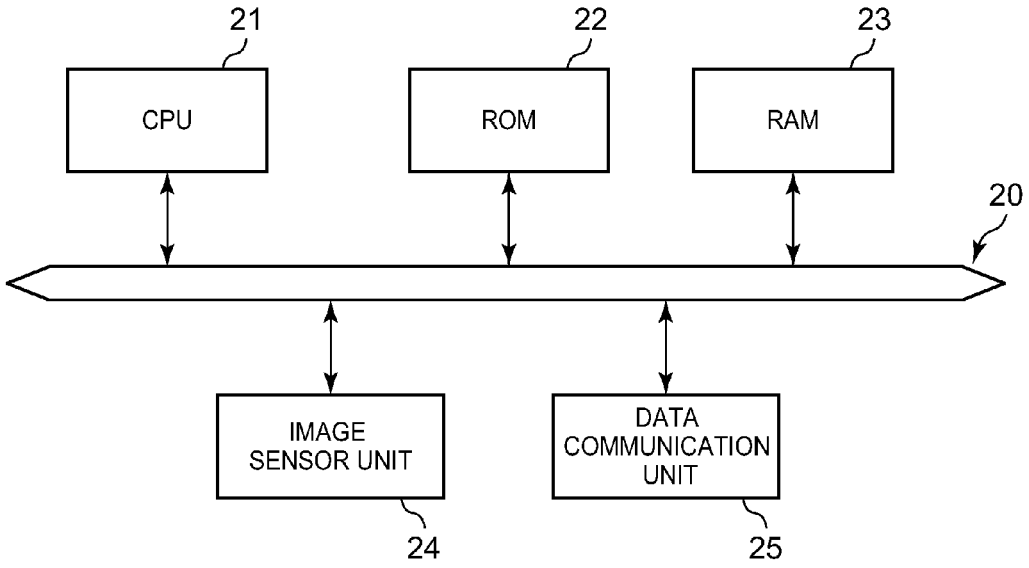
FIG. 4 is a block diagram of a hardware configuration of a camera unit composing the performance apparatus according to the embodiment of the invention.

FIG. 4 is a block diagram of a hardware configuration of the camera unit 20. The configuration of the camera unit 20 will be described with reference to the block diagram shown in FIG. 4. The camera unit 20 comprises CPU 21, ROM 22, RAM 23, an image sensor unit 24, and a data communication unit 25.

CPU 21 controls the whole operation of the camera unit 20. When no wind-chime operation signal is received from the stick unit 10, CPU 21 obtains image-pickup data from the image sensor unit 24 to detect the position-coordinate data and marker featuring information of the marker unit 15. And CPU 21 calculates the position coordinates of the marker unit (first marker) 15 of the stick unit 10A and the position coordinates of the marker unit (second marker) 15 of the stick unit 10B from the detected position-coordinate data and marker featuring information of the marker unit 15, and controls an output operation of the position-coordinate data representing the calculation result.

Meanwhile, when the wind-chime operation signal is received from the stick unit 10, CPU 21 detects based on plural pieces of image-pickup data obtained from the image sensor unit 24, that an operating position of the marker unit 15 has moved. That is, based on information of brightness, color phase and/or intensity involved in the plural pieces of image-pickup data obtained from the image sensor unit 24, CPU 21 creates binary image-pickup data to determine a candidate marker position, and stores the candidate marker position in RAM 23. Further, CPU 21 obtains from RAM 23 the binary image-pickup data, which has been created from the image-pickup data corresponding to the predetermined number of frames prior to the frame of the latest image-pickup data. CPU 21 calculates difference data (difference image) between the binary image-pickup data created from the latest image-pickup data and the binary image-pickup data created from the image-pickup data corresponding to the predetermined number of frames prior to the latest frame. In the difference data (difference image), an area where the difference is found will be different in color (marker emitting color) from other area (for example, in black color). Hereinafter, the area where the difference is found is referred to as the "difference area".

When the size of the difference area in the difference data (difference image) is a predetermined value or larger, CPU 21 detects the operating position of the marker unit 15 based on the difference image. When the size of the difference area in the difference image is smaller than the predetermined value, CPU 21 sets the operating position detected last time as the present operating position. More particularly, CPU 21 performs a process of removing the difference areas having a size of smaller than the predetermined value (for example, less than several pixels) from the difference areas in the difference data (difference image), that is, CPU 21 performs a process of leaving behind only the difference areas having the same color (for example, black color) as the other areas. It is presumed that the above predetermined value is previously determined. Hereinafter, the difference areas, which are to be removed, that is, the difference areas having the size of smaller than the predetermined value, are referred to as the "minor difference areas". The minor difference areas are produced by a jiggly motion of the stick unit 10, when the player keeps rhythm. In the difference data with the minor difference areas removed are left behind only the difference areas having a size of larger than the predetermined value. These difference areas are areas produced when the player intentionally performs an operation of tracing the position of the virtual wind chimes. Based on the difference areas (difference areas having the size of larger than the predetermined value) involved in the difference data with the minor difference areas removed, CPU 21 confirms that the operating position of the marker unit 15 has moved to the present position of the marker unit 15, and detects the present position of the marker unit 15. Meanwhile, when no difference areas are left in the difference data with the minor difference areas removed, CPU 21 sets the previous operating position of the marker unit 15 as the present position of the marker unit 15. Further, when the player has not moved the stick unit 10, no difference area is produced in the difference data, on which the process of removing the difference areas has not been performed. In this case, CPU 21 sets the operating position of the marker unit 15 detected last time to the present operating position.

When producing the binary image-pickup data, it is possible for CPU 21 to produce the binary image-pickup data by limiting the area to the area corresponding to the position of the virtual wind chimes 91, as will be described later. Further, CPU 21 can start producing the binary image-pickup data at the time when the data communication unit 25 has received a wind-chime operating signal. The above arrangement reduces a burden of performing a process of calculating the difference areas.

CUP 21 controls the data communication unit 25 to send the calculated position-coordinate data to the center unit 30.

ROM 22 serves to store a process program for CPU 21 to performs various processes. RAM 23 serves to store image-pickup data obtained by the image sensor 24, and various values obtained or produced during the course of performing various processes. Further, RAM 23 stores the marker featuring information of the stick units 10A, 10B sent from the center unit 30.

The image sensor unit 24 is, for example, an optical camera, and is used to takes at a predetermined frame rate, images of the player who performs the playing operation, holding the stick units 10 with his or her hands. The image sensor unit 24 sends CPU 21 image-pickup data of each of frames. It is possible to make the image sensor unit 24 in place of CPU 21 specify the position coordinates of the marker unit 15 of the stick unit 10 in the pickup image. Further, it is possible to make the image sensor unit 24 in place of CPU 21 calculate the position coordinates of marker units 15, 15 (first and second markers) of the stick units 10A, 10B.

The data communication unit 25 performs a wireless communication (for example, an infrared communication) at least with the center unit 30. It is possible to make the data communication unit 25 perform the wireless communication with stick unit 10.

[Configuration of Center Unit]

Figure 5:
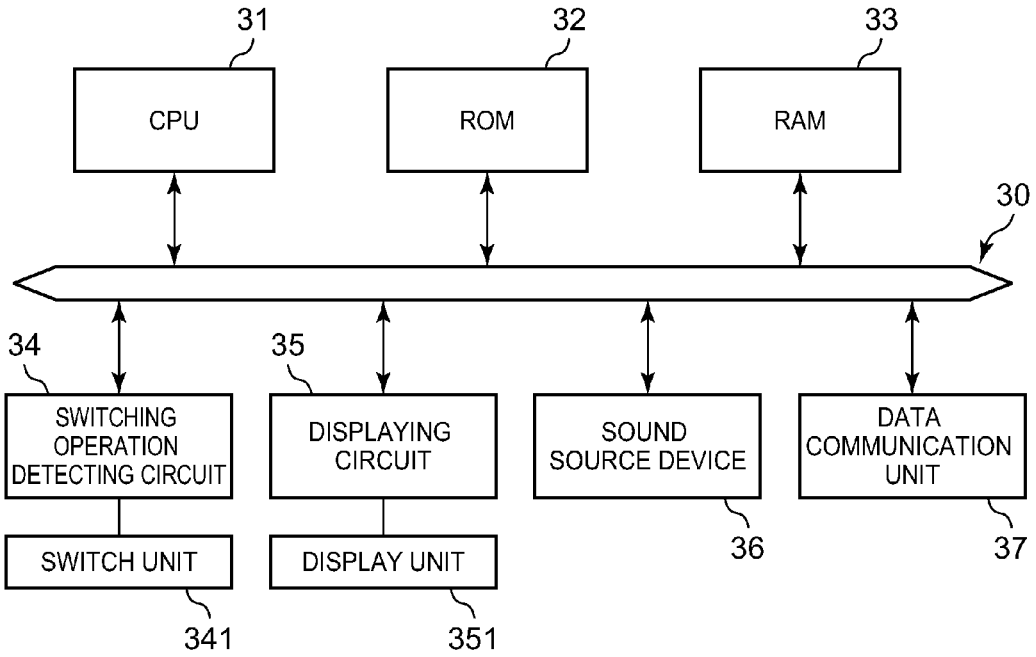
FIG. 5 is a block diagram of a hardware configuration of a center unit composing the performance apparatus according to the embodiment of the invention.

FIG. 5 is a block diagram of a hardware configuration of the center unit 30. The configuration of the center unit 30 will be described with reference to the block diagram shown in FIG. 5. The center unit 30 comprises CPU 31, ROM 32, RAM 33, a switching operation detecting circuit 34, a displaying circuit 35, a sound source device 36, and a data communication unit 37.

CPU 31 controls the whole operation of the center unit 30. For example, CPU 31 controls a sounding operation of generating a predetermined musical tone based on a shot detection received from the stick unit 10 and the position-coordinate data of the marker unit 15 received from the camera unit 20. Further, CPU 31 controls a communication between the stick unit 10 and the camera unit 20 through the data communication unit 37.

ROM 32 serves to store a process program for CPU 31 to control the whole operation of the center unit 30. Further, ROM 32 stores set-layout information, which correlates plural pieces of waveform data of sounds with various virtual musical instruments set respectively at the position coordinates of plural areas defined on a virtual plane. ROM 32 stores, for example, plural pieces of waveform data (timbre data) correlated with position coordinates, wherein the plural pieces of waveform data include waveform data of wind instruments such as flutes, saxes, trumpets, keyboard instruments such as pianos, string instruments such as guitars, and percussion instruments such as bass drums, hi-hats, snare drums, cymbals, toms, and wind chimes.

Figure 6:
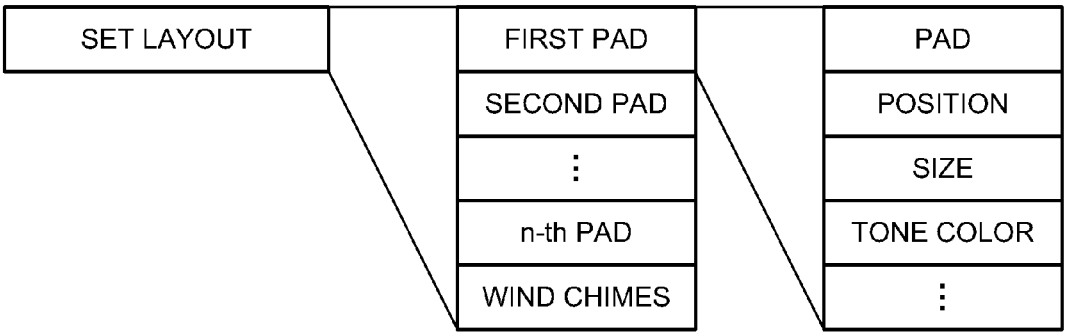
FIG. 6 is a view showing set-layout information used in the performance apparatus according to the embodiment of the invention.

Various sorts of tone-color data correlated with the set-layout information are stored in ROM 32. FIG. 6 is a view showing an example of the set-layout information used in the performance apparatus according to the present embodiment of the invention. As shown in FIG. 6, one piece of set-layout information is correlated with "n" pieces of information (pad information) of pads (first pad to n-th pad) and wind-chime information. And each piece of pad information is correlated with a pad position (position coordinates on the virtual plane), a pad size (shape and diameter of a virtual pad), a tone color of the pad (waveform data), and so on. The wind-chime information is divided into plural rectangular areas, and positions, sizes and tone colors of the plural rectangular areas are correlated with each other.

It is possible to prepare plural sorts of set-layout information representing positions and tone colors of plural virtual pads and wind chimes.

Figure 7:
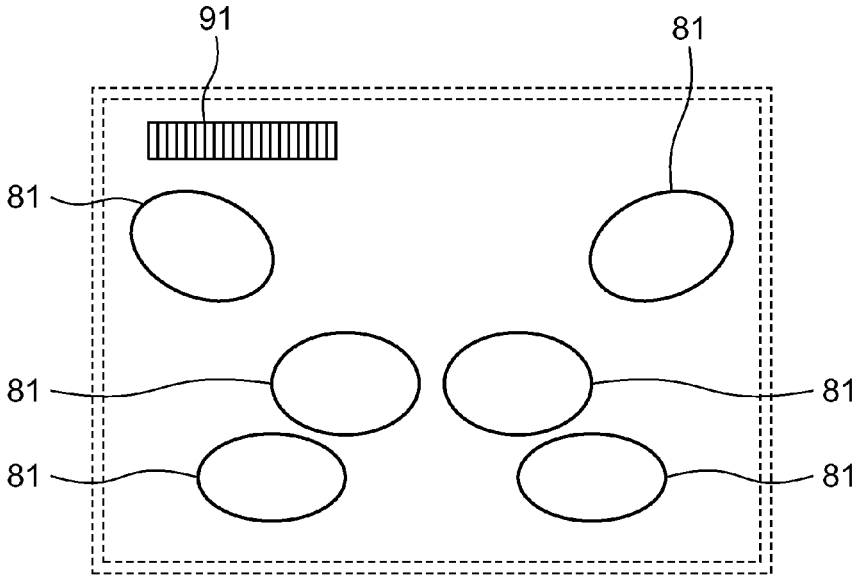
FIG. 7 is a view showing a virtual plane, which visualizes a concept represented by the set-layout information used in the performance apparatus according to the embodiment of the invention.

FIG. 7 is a view showing a virtual plane, on which a concept is visualized, represented by the set-layout information stored in ROM 32 of the center unit 30. Specific set-layout information will be described with reference to the view shown in FIG. 7.

As shown in FIG. 7, 6 pieces of virtual pads 81 are disposed on the virtual plane, and 6 pads corresponding to 6 virtual pads are disposed. These 6 virtual pads 81 are disposed based on position data and size data correlated with the pads. Each virtual pad 81 is correlated with tone-color data. Therefore, when the position coordinates that the marker unit 15 takes at the time of the shot detection belongs to the areas corresponding to the virtual pads 81, then tones of the tone colors corresponding to the virtual pads 81 are generated.

As shown in FIG. 7, the virtual wind chimes 91 is disposed on the virtual plane. The virtual wind chimes 91 are divided into plural areas. As shown in FIG. 7, the virtual wind chimes 91 are divided into 20 pieces of areas. Each of the 20 areas is disposed based on the position data and size data of the area memorized in the set-layout information. In the present embodiment, with respect to the virtual wind chimes 91, its states detected at the respective areas are defined by B1 to B20, respectively, and the state not detected is defined by B0. For instance, when the player turns on the switch unit 171 of the stick unit 10, the wind-chime operating signal is generated, allowing the player to operate virtual wind chimes 91. Meanwhile, when it is confirmed that the position coordinates of the marker unit 15 falls in the area of the virtual wind chimes 91, then the wind-chime detecting state will be Bn ($1 \leq n \leq 20$) and CPU 31 generates a sound of a tone color corresponding to Bn.

RAM 33 shown in FIG. 5 stores values obtained or produced in the process, including the state (shot detection, and so on) of the stick unit 10 sent from the stick unit 10 and the position coordinates of the marker unit 15 sent from the camera unit 20.

CPU 31 reads the tone-color data (waveform data) of the virtual pad 81 or the virtual wind chimes 91 from the set-layout information stored in RAM 33, and generates a musical tone in response to the player's playing performance, wherein the virtual pad 81 or the virtual wind chimes 91 corresponds to the area, to which the position coordinates of the marker unit 15 belongs at the time of shot detection (that is, at the time when the note-on event is received) or at the time when the wind-chime operating signal is received.

The switching operation detecting circuit 34 is connected with the switch 341, and receives input information via the switch 341. The input information represents a sound volume of a musical note to be generated, a change of the tone color of a musical tone to be generated, and switching a display on a display unit 351.

The displaying circuit 35 is connected with the display unit 351, and controls a displaying operation of the display unit 351.

The sound source device 36 reads the waveform data from ROM 32 under control of CPU 31 to generate musical-tone data. Further, the sound source device 36 converts the musical-tone data into an analog signal to generate a musical tone through a speaker (not shown).

The data communication unit 37 performs a wireless communication (for example, the infrared communication) with the stick unit 10 and the camera unit 20. For example, the data communication unit 37 receives the wind-chime operating signal from the stick unit 10

[Process of Performance Apparatus]

The processes performed by the performance apparatus 1 will be described with reference to flowcharts shown in FIG. 8 to FIG. 10.

[Process Performed by Stick Unit]

Figure 8:
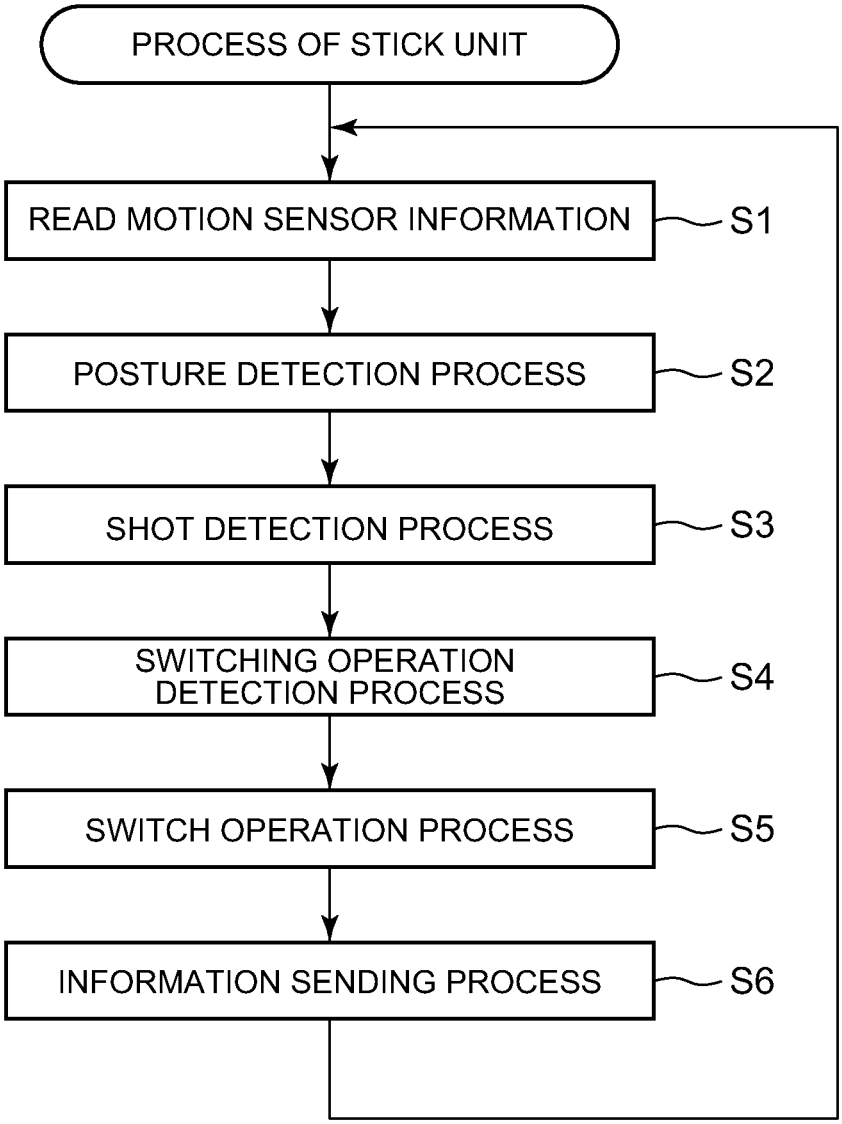
FIG. 8 is a flow chart of a process performed by the stick unit in the performance apparatus according to the embodiment of the invention.

FIG. 8 is a flow chart of the process performed by the stick unit 10. CPU 11 of the stick unit 10 reads motion sensor information (sensor value) from the motion sensor unit 14, and stores the sensor value in RAM 13 (step S1). Then, CPU 11 performs a posture detecting process to detect the posture of the stick unit 10 based on the motion sensor information read from the motion sensor unit 14 (step S2). In the posture detecting process, CPU 11 calculates the posture (roll angle, pitch angle, etc.) of the stick unit 10 based on the motion sensor information.

Further, CPU 11 performs a shot detection process based on the motion sensor information (step S3). The shot detection process is performed while the switch unit 171 of the stick unit 10 is kept turned off. When the player gives a performance with the stick unit 10, the player performs a playing motion to drum the virtual musical instrument (virtual drum) with the stick unit 10, as if the player drums a real musical instrument set in front of him or her. At first, the player swings the stick unit 10 up and then down to drum the virtual musical instrument. The player supposes that a musical tone is generated at the moment when he or she has drummed the virtual musical instrument, and the player stops his or her drumming motion against the virtual musical instrument right before drumming the virtual musical instrument with the stick unit 10. At this moment, CPU 11 detects the motion of stopping the drumming motion, based on the motion sensor information (for example, a resultant sensor value of the acceleration sensor).

In the present embodiment, the timing of the shot detection is the timing right before the movement of the stick unit 10 is stopped after the stick unit 10 is swung down, and the timing at which the acceleration rate has exceeded a threshold value, in the direction opposite to the direction in which the stick unit 10 is swung down. In the present embodiment, the timing of the shot detection is set to the timing of the sound generation.

When determining that the timing of the sound generation has reached, CPU 11 of the stick unit 10 generates a note-on event and sends the note-on event to the center unit 10. When the note-on event is generated, it is possible for CPU 11 to determine a sound volume of a musical tone to be generated, based on the motion sensor information (for example, the maximum sensor resultant value of the acceleration sensor) and to include the determined sound volume of the musical tone in the note-on event.

Then, CPU 11 performs a switch-operation detecting process (step S4). More specifically, CPU 11 judges whether the switch unit 171 of the stick unit 10 has been turned on during the process of the shot detection. When it is determined that the switch 171 has been turned on, CPU 11 determines that the switch unit 171 has been operated.

CPU 11 performs a switch-operation process (step S5). More particularly, in the switch-operation process, CPU 11 determines in the switch-operation detecting process that the switch unit 171 of the stick unit 10 has been turned on, and then makes the switching operation detecting circuit 17 output switch-operation information representing that the switch unit 171 of the stick unit 10 has been operated. In the switch-operation process, CPU 11 performs the switch-operation process until the switch unit 171 will not be operated.

Further, CPU 11 sends information detected in the processes at step S2 to step S5 to the center unit 30 through the data communication unit 16 (step S6), wherein the above information includes posture information, shot information and the switch-operation information. At this time, CPU 11 sends the center unit 30 the posture information, the shot information and the switch-operation information, which are correlated with stick discriminating information. Then, CPU 11 returns to step S1, and repeatedly performs the processes at step S1 to step S6.

[Process Performed by Camera Unit]

Figure 9:
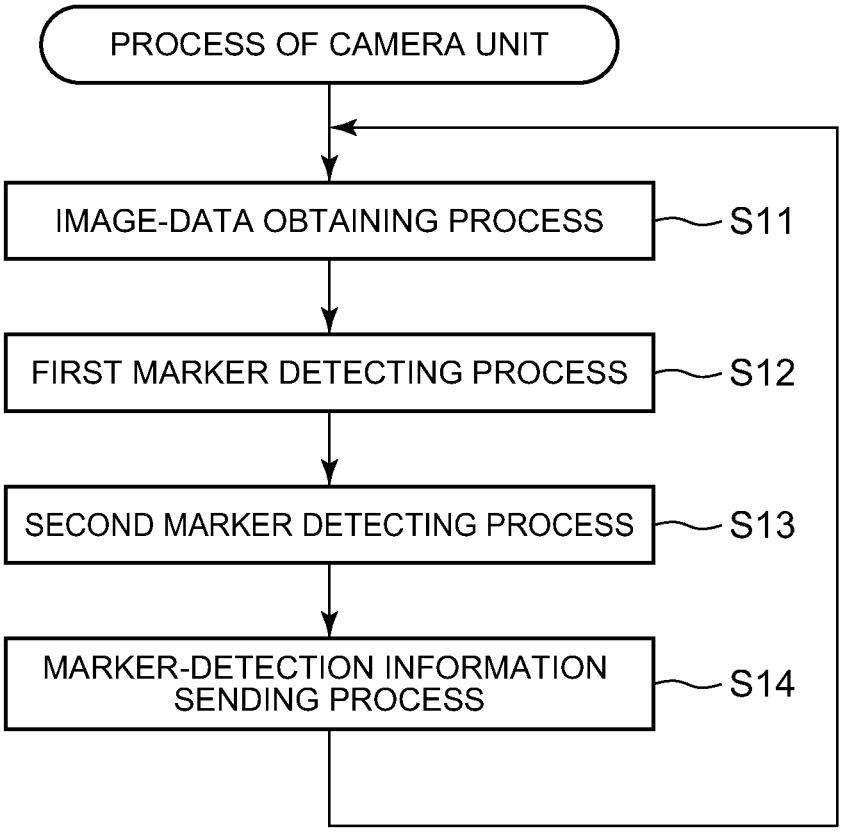
FIG. 9 is a flow chart of a process (camera-unit process) performed by the camera unit in the performance apparatus according to the present embodiment.

FIG. 9 is a flow chart of a process (camera-unit process) performed by the camera unit 20 in the performance apparatus 1 according to the present embodiment. The process performed by CPU 21 of the camera unit 20 will be described with reference to the flowchart of FIG. 9. CPU 21 of the camera unit 20 performs an image-data obtaining process (step S11). In the image-data obtaining process, CPU 21 obtains image data from the image sensor unit 24.

CPU 21 performs a first marker detecting process (step S12) and a second marker detecting process (step S13). In these processes, when no wind-chime operating signal is received, CPU 21 obtains marker-detection information and stores the obtained information in RAM 23, wherein the marker-detection information contains the position coordinates, sizes and angles of the marker unit (first marker) 15 of the stick unit 10A and the marker unit (second marker) 15 of the stick unit 10B, detected by the image sensor unit 24. At this time, the image sensor unit 24 detects the marker-detection information from the marker unit 15 while the marker unit 15 is emitting light.

Meanwhile, when the wind-chime operating signal is received, CPU 21 receives image-pickup data from the image sensor unit 24 and produces binary image-pickup data from the received image-pickup data, based on information of brightness, color phase, and/or intensity. Further, CPU 21 calculates difference data (difference image) between the binary image-pickup data produced from the latest image-pickup data and the binary image-pickup data produced from the image-pickup data corresponding to the predetermined number of frames prior to the latest frame. CPU 21 removes from the difference data the minor difference areas, which are produced by a jiggly motion of the stick unit 10, when the player keeps rhythm, and then based on the difference areas left in the difference data with the minor difference areas removed, CPU 21 confirms that the operating position of the marker unit 15 has moved to the present operating position and detects the present operating position of the marker unit 15.

Then, CPU 21 sends the center unit 30 the marker-detection information obtained in the processes at step S12 and step S13 through the data communication unit 25 (step S14), and returns to step S11.

[Process Performed by Center Unit]

Figure 10:
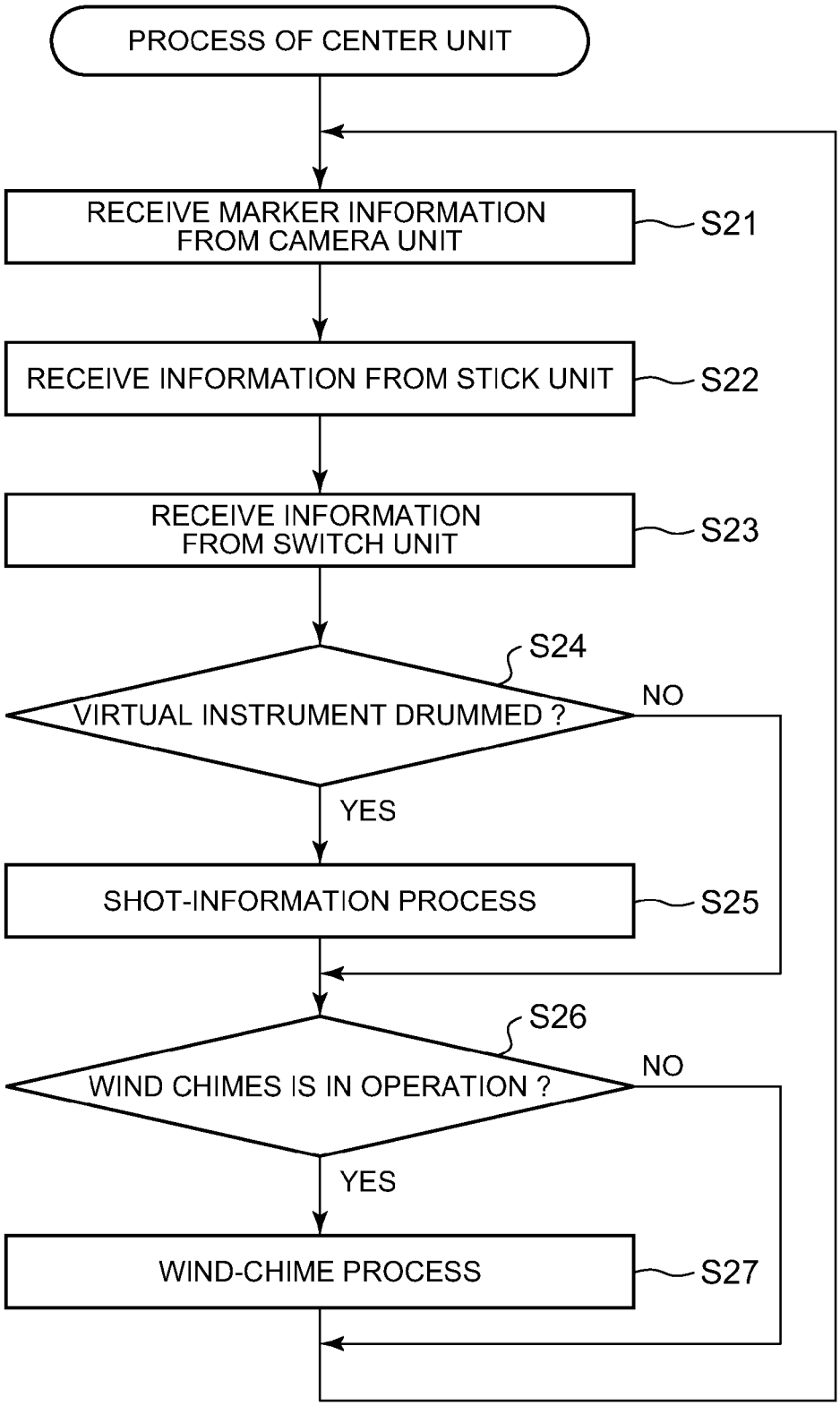
FIG. 10 is a flow chart of a process (center-unit process) performed by the center unit in the performance apparatus according to the present embodiment.

FIG. 10 is a flowchart of a process (center-unit process) performed by the center unit 30 in the performance apparatus 1 according to the present embodiment.

CPU 31 of the center unit 30 receives the marker detection information of the first marker and the marker detection information of the second marker from the camera unit 20, and stores the received information in RAM 33 (step S21). Further, CPU 31 receives the posture information and shot information correlated with the stick discriminating information from the stick units 10A, 10B, and stores the received information in RAM 33 (step S22). Further, CPU 31 receives the wind-chime operating signal from either the stick unit 10A or the stick unit 10B. Also CPU 31 receives information input in response to the operation of the switch unit 341 (step S23).

CPU 31 judges whether the player has drummed the virtual musical instrument with the stick unit 10, that is, CPU 31 judges whether the note-on event has been received from the stick unit 10 (step S24). When it is determined YES at step S24, CPU 31 performs a shot-information process (step S25). In the shot-information process, CPU 31 reads from the set-layout information expanded on RAM 33 the tone-color data (waveform data) of the virtual pad 81 corresponding to the area, to which the position coordinates involved in the marker-detection information belongs, and sends the sound source device 36 the tone-color data (waveform data) together with the sound-volume data included in the note-on event. Then, the sound source device 36 generates a musical tone based on the received waveform data.

After the shot-information process finishes (step S25) or when it is determined NO at step S24, CPU 31 judges whether the wind chimes are in operation (step S26). In this process, CPU 31 receives a wind chime signal to judge whether either of the position coordinates contained in the marker detection information of the first marker and the position coordinates contained in the marker detection information of the second marker is contained in the area corresponding to the virtual wind chimes 91. When it is determined that the position coordinates of the first marker or the second marker is contained in the area corresponding to the virtual wind chimes 91, that is, when it is determined that the wind chimes are in operation (YES at step S26), CPU 31 performs a wind-chime process (step S27).

In the wind-chime process, CPU 31 specifies the area in which the marker falls from among plural areas corresponding to the virtual wind chimes, based on the position coordinates contained in the marker detection information, and determines that the wind-chime detecting state is either of B1 to B20. CPU 31 stores the determined wind-chime detecting state in RAM 33. Further, CPU 31 reads the just previous wind-chime detecting state from RAM 33 to compare the just previous wind-chime detecting state with the determined wind-chime detecting state. When both wind-chimes detecting states do not coincide with each other, CPU 31 specifies a difference area between the two states, and reads tone-color data (waveform data) corresponding to the specified area from ROM 32, and sends the sound source device 36 the tone-color data (waveform data). Then, the sound source device 36 generates a musical tone based on the received waveform data.

The configuration of the performance apparatus 1 according to the present embodiment and the process performed in the performance apparatus have been described. In the performance apparatus 1 according to the present embodiment of the invention, the image sensor unit 24 obtains plural pickup images at a predetermined frame rate, and CPU 21 calculates a difference image between the first pickup image and the second pickup image, which was obtained prior to the first pickup image. When the difference area in the calculated difference image representing a difference between them has a size of a predetermined value or larger, CPU 21 detects the operating position of the sick unit 10 based on the difference image. Meanwhile, when the size of difference area is less than the predetermined value, CPU 21 sets the previously detected operating position as the present operating position of the sick unit 10. Further in the performance apparatus 1, CPU 31 of the center unit 30 refers to the waveform data stored in ROM 32 to specify atone color correlated with the area corresponding to the operating position of the stick unit 10 detected by CPU 21 of the camera unit 20, and the sound source device 36 generates a sound of the tone color specified by CPU 31 of the center unit 30.

Even though the player jiggles the stick unit 10 up and down to keep rhythm, the performance apparatus 1 does not detect such jiggly movement of the stick unit 10. In other words, the performance apparatus 1 prevents the jiggly movement of the stick unit 10 from being detected, when the player plays the virtual musical instrument set, thereby disregarding the player's unintentional motion and generating no sound.

In the performance apparatus 1 according to the embodiments of the invention, when the difference areas representing a difference between the first and the second pickup images are not included in the difference image, CPU 21 of the camera unit 20 sets the previously detected operating position of the stick unit 10 to the present operating position. Therefore, when the player moves to the next motion, the operating position of the following motion is detected, and the detected operation position is compared with the present operating position of the stick unit 10. As a result, it can be detected without failure, that the stick unit 10 has been moved.

In the performance apparatus 1 according to the embodiments of the invention, the stick unit 10 is provided with the switching operation detecting circuit 17, which generates the wind-chime operating signal upon receipt of the player's operation, and CPU 31 specifies a tone color of the virtual wind chimes 91, when receiving the wind-chime operation signal from the switching operation detecting circuit 17.

Upon receipt of the operation of the player, the performance apparatus 1 generates a sound of the tone color of the wind chimes 91, therefore the performance apparatus 1 can prevent a sound from being generated, which sound the player does not want.

Although specific embodiments of the present invention have been described in the above description, it will be understood that the invention is not limited to the particular embodiments described herein, but numerous rearrangements, modifications, and substitutions may be made to the disclosed embodiments while remaining within the scope of the invention as defined by the following claims and the equivalents thereof.

In the embodiments described above, when receiving the wind-chime operating signal, the performance apparatus 1 generates a sound of the tone color of the virtual wind chimes 91 based on the difference image, but the invention is not limited to such technique. It is possible for the performance apparatus 1 to produce plural pieces of binary image data at all times and to obtain difference image between them, and further to control generation of a sound of the tone color of the virtual wind chimes based on the difference image.

The performance apparatus 1 according to the embodiments of the invention has been described, taking the virtual drum set "D" (FIG. 1B) for an example of the virtual percussion instruments. The invention is not limited to the virtual drum set, but the invention can be applied to other musical instruments such as xylophones, which generates a musical sound in response to the player's swinging-down motion of the stick unit 10.

In the performance apparatus 1 according to the embodiments of the invention, three processes are performed by stick unit 10, camera unit 20, and the center unit 30, respectively, but either of these processes may be performed by other unit. For example, it is possible to make the center unit 30 perform the shot detecting operation and calculation of the roll angle in place of CPU 11 of the stick unit 10.

The processes described above can be performed using hardware, and also can be performed using software. In other words, the configurations shown in FIG. 2, FIG. 4 and FIG. 5 are provided for illustrative purposes only. It is enough for the performance apparatus 1 to equip with functions capable of performing these processes. Concerning what configurations should be employed to realize these functions, it is not limited to the configurations shown in FIG. 2, FIG. 4 and FIG. 5.

When these process are performed using software, a program composing the software is installed on a computer through networks and/or recording media. The computer mounted on specialized hardware can be used. The computer, which has various programs installed on and is capable of performing various functions, can be used.

What is claimed is:

1. A performance apparatus comprising:

a performance member which is operable by a player;

a storing unit which stores layout information including positions of plural areas set on a virtual plane;

an image pickup unit which continuously takes pickup images including the performance member and a region of the virtual plane in which the performance member is operated;

a position detecting unit which detects a position of the performance member on the virtual plane in a first pickup image and a position of the performance member on the virtual plane in a second pickup image among the pickup images taken by the image pickup unit, wherein the second pickup image was taken prior to the first pickup image;

a present position determining unit which compares the two positions of the performance member detected by the position detecting unit to judge whether the difference between the two positions of the performance member is more than a predetermined value, and which sets the position of the performance member on the virtual plane in the first pickup image as a present position of the performance member when it is determined that the difference between the two positions of the performance member is more than the predetermined value, and sets the position of the performance member on the virtual plane in the second pickup image as the present position of the performance member when it is determined that the difference between the two positions of the performance member is less than the predetermined value; and a sound-generation instructing unit which instructs generation of a musical tone corresponding to an area including the present position of the performance member determined by the present position determining unit, when the difference between the two positions of the performance member detected by the position detecting unit is more than the predetermined value and the present position of the performance member determined by the present position determining unit is included in one of the plural areas whose positions are included in the layout information.

2. The performance apparatus according to claim 1, wherein:

the performance member includes a switch unit; and the sound-generation instructing unit gives the instruction of generating the musical tone corresponding to the area including the determined present position of the performance member, when the switch unit is turned on.

3. The performance apparatus according to claim 1, wherein the musical tone, which corresponds to the area including the present position of the performance member and which is generated in response to the instruction by the sound-generation instructing unit, includes a tone of a wind chime.

4. The performance apparatus according to claim 2, wherein the musical tone, which corresponds to the area including the present position of the performance member and which is generated in response to the instruction by the sound-generation instructing unit, includes a tone of a wind chime.

5. A non-transitory computer readable recording medium having stored thereon a program for controlling a computer of a performance apparatus, wherein the performance apparatus includes a performance member which is operable by a player, a storing unit which stores layout information including positions of plural areas set on a virtual plane, and an image pickup unit which continuously takes pickup images including the performance member and a region of the virtual plane in which the performance member is operated, and wherein the computer program, when read and executed by the computer, controls the computer to implement functions comprising:

detecting a position of the performance member on the virtual plane in a first pickup image and a position of the performance member on the virtual plane in a second pickup image among the pickup images taken by the image pickup unit, wherein the second pickup image was taken prior to the first pickup image;

comparing the two detected positions of the performance member to judge whether the difference between the two detected positions of the performance member is more than a predetermined value, and setting the position of the performance member on the the virtual plane in the first pickup image as a present position of the performance member when it is determined that the difference between the two detected positions of the performance member is more than the predetermined value, and setting the position of the performance member on the virtual plane in the second pickup image as the present position of the performance member when it is determined that the difference between the two detected positions of the performance member is less than the predetermined value; and instructing generation of a musical tone corresponding to an area including the determined present position of the performance member when the difference between the two detected positions of the performance member is more than the predetermined value and the determined present position of the performance member is included in one of the plural areas whose positions are included in the layout information.

6. A method of controlling a performance apparatus, wherein the performance apparatus includes a performance member which is operable by a player, a storing unit which stores layout information including positions of plural areas set on a virtual plane, and an image pickup unit which continuously takes pickup images including the performance member and a region of the virtual plane in which the performance member is operated, the method comprising:

a detecting a position of the performance member on the virtual plane in a first pickup image and a position of the performance member on the virtual plane in a second pickup image among the pickup images taken by the image pickup unit, wherein the second pickup image was taken prior to the first pickup image;

comparing the two detected positions of the performance member to judge whether the difference between the two detected positions of the performance member is more than a predetermined value, and setting the position of the performance member on the virtual plane in the first pickup image as a present position of the performance member when it is determined that the difference between the two detected positions of the performance member is more than the predetermined value, and setting the position of the performance member on the the virtual plane in the second pickup image as the present position of the performance member when it is determined that the difference between the two detected positions of the performance member is less than the predetermined value; and instructing generation of a musical tone corresponding to an area including the determined present position of the performance member when the difference between the two detected positions of the performance member is more than the predetermined value and the determined present position of the performance member is included in one of the plural areas whose positions are included in the layout information.

7. The performance apparatus according to claim 1, wherein the image pickup unit continuously takes images of the performance member while it is operated by the user in an operation region including the virtual plane.

8. The non-transitory computer readable recording medium according to claim 5, wherein the computer program stored thereon controls the computer to operate the image pickup unit to continuously take images of the performance member while it is operated by the user in an operation region including the virtual plane.

9. The method according to claim 6, wherein the image pickup unit is controlled to continuously take images of the performance member while it is operated by the user in an operation region including the virtual plane.

* * * * *